US007578390B2

(12) United States Patent
Ting

(10) Patent No.: US 7,578,390 B2
(45) **Date of Patent: *Aug. 25, 2009**

(54) CUSHION STRUCTURE

(75) Inventor: Chung-Kuan Ting, Taipei County (TW)

(73) Assignee: AU Optronics Corp., Hsinchu (TW)

( * ) Notice: Subject to any disclaimer, the term of this patent is extended or adjusted under 35 U.S.C. 154(b) by 0 days.

This patent is subject to a terminal disclaimer.

(21) Appl. No.: 11/967,321

(22) Filed: Dec. 31, 2007

(65) Prior Publication Data

US 2008/0099369 A1 May 1, 2008

Related U.S. Application Data

(63) Continuation of application No. 11/229,791, filed on Sep. 19, 2005, now Pat. No. 7,374,044.

(30) Foreign Application Priority Data

Feb. 17, 2005 (TW) ..... 94104603 A

(51) Int. Cl.
*B65D 85/48* (2006.01)

(52) U.S. Cl. ..... 206/454; 206/587; 206/592

(58) Field of Classification Search ..... 206/453–455, 206/521, 523, 586, 587, 591–594, 525, 526
See application file for complete search history.

(56) References Cited

U.S. PATENT DOCUMENTS 4,427,108 A * 1/1984 Coles et al. ..... 206/526
4,518,085 A * 5/1985 Chisholm et al. ..... 206/454
4,779,752 A 10/1988 Vallee et al.
4,792,043 A * 12/1988 Holladay ..... 206/587
5,398,808 A 3/1995 Chen et al.
5,857,573 A 1/1999 Pakeriasamy
6,145,663 A 11/2000 Kim et al.
6,837,421 B1 * 1/2005 Li et al. ..... 206/593
7,225,925 B2 * 6/2007 Chen et al. ..... 206/454
7,296,680 B2 * 11/2007 Yokawa ..... 206/521
7,374,044 B2 * 5/2008 Ting ..... 206/454
2001/0027934 A1 10/2001 Yoneda et al.
2005/0006266 A1 1/2005 Kurikawa
2005/0173294 A1 8/2005 Chen et al.

* cited by examiner

*Primary Examiner*—Luan K Bui
(74) *Attorney, Agent, or Firm*—Thomas, Kayden, Horstemeyer & Risley

(57) ABSTRACT

A cushion structure comprises a first fixing element, a second fixing element, a first cushion element, and a second cushion element. The first fixing element comprises a first board. The second fixing element comprises a second board and faces the first fixing element. The first cushion element is fixed on the first board and the second board near a side thereof. The first cushion element comprises a plurality of first spacers and first grooves. The second cushion element is fixed on the first board and the second board near another side thereof facing the first cushion element. The second cushion element comprises a plurality of second spacers and second grooves. The second grooves face the first grooves.

9 Claims, 6 Drawing Sheets

CUSHION STRUCTURE

CROSS REFERENCE TO RELATED APPLICATIONS

This application is a continuation application of pending U.S. patent application Ser. No. 11/229,791, filed on Sep. 19, 2005 and entitled "CUSHION STRUCTURE".

BACKGROUND

The invention relates to a cushion structure, and more particularly to a cushion structure for protecting panels or glass substrates.

FIG. 1*a* shows of a conventional cushion structure 1, which comprises a cushion element 2, a cushion element 3 and a lid 6. Cushion element 2 comprises fixing portion 4 and cushion portion 7, wherein cushion portion 7 is around fixing portion 4. Cushion element 3 comprises fixing portion 5 and cushion portion 8, wherein cushion portion 8 surrounds fixing portion 5. The fixing portion 4 faces the fixing portion 5, and panels or glass substrates are inserted therebetween. After panels or glass substrates are inserted between fixing portion 4 and fixing portion 5, lid 6 is placed on fixing portion 4 and fixing portion 5.

As shown in FIG. 1*b*, during transport, a force F1 is applied on an upper edge of the cushion structure contained in a box 9, and a force F2 is applied on a middle edge thereof. With reference to FIG. 1*a*, because the lid 6 is placed on the fixing portion 4 and the fixing portion 5 without embedding therein, the conventional cushion structure 1 is weak in absorbing force F1 applied on the upper edge thereof. Additionally, cushion structure 1 absorbs impact (for example, force F2 applied on the middle edge thereof) with cushion portions 7 and 8 only. Thus, thickness of cushion portions 7, 8 and volume of cushion structure 1 are increased.

SUMMARY

The invention provides a cushion structure for protecting at least one panel. The cushion structure comprises a first fixing element, a second fixing element, a first cushion element, and a second cushion element. The first fixing element comprises a first board. The second fixing element comprises a second board and faces the first fixing element. The first cushion element is fixed on the first board and the second board near a side thereof. The first cushion element comprises a plurality of first spacers and first grooves. The second cushion element is fixed on the first board and the second board near another side thereof facing the first cushion element. The second cushion element comprises a plurality of second spacers and second grooves. The second grooves face the first grooves.

The cushion structure of the invention absorbs impact applied on every side and edge thereof and protects the panel or other breakable packaged therein. Additionally, the size and volume of the cushion structure of the invention are reduced.

BRIEF DESCRIPTION OF THE DRAWINGS

The invention will be more fully understood from the following detailed description and the accompanying drawings, given by the way of illustration only and thus not intended to limit the disclosure.

DETAILED DESCRIPTION

First Embodiment

Figure 1A:
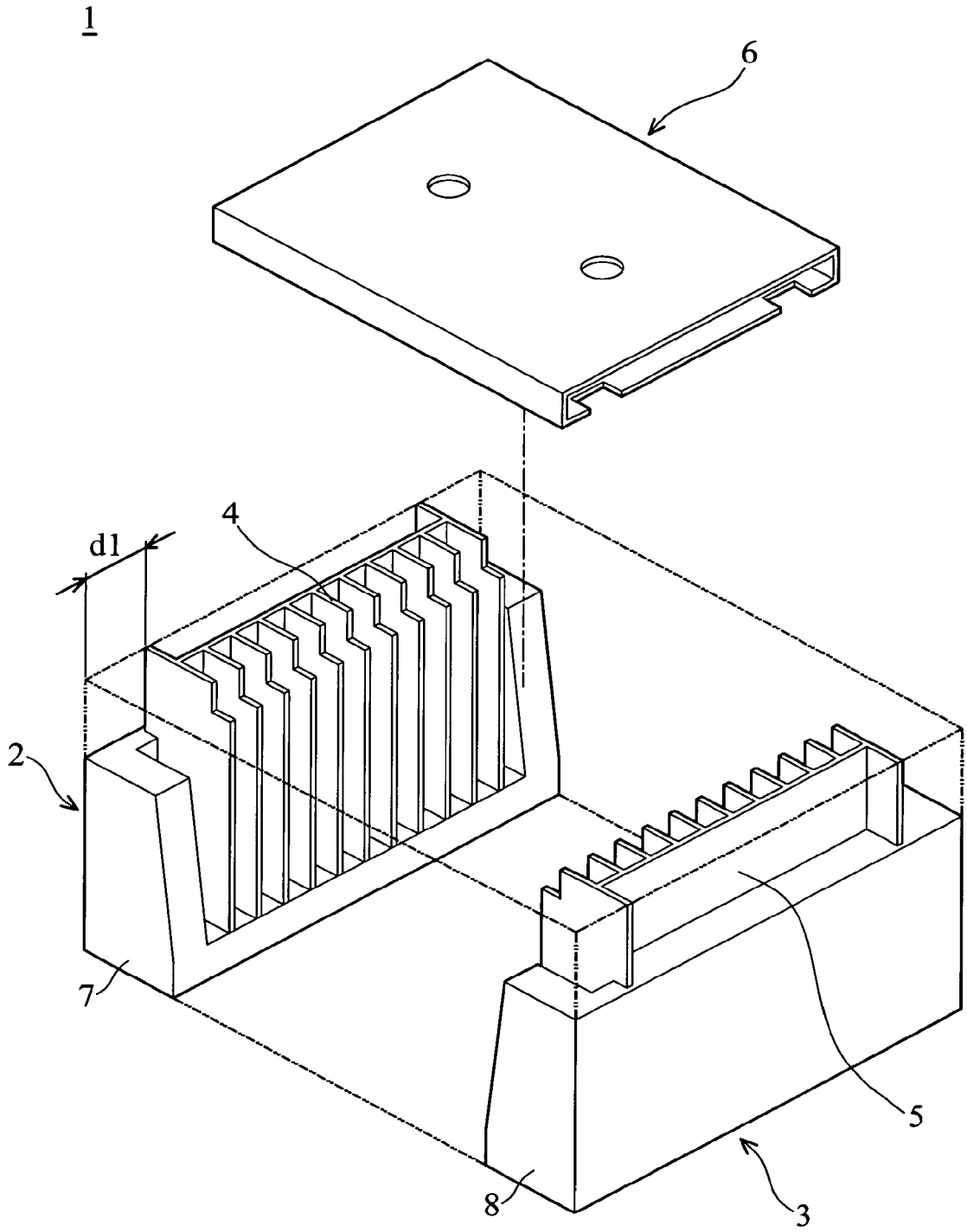
FIG. 1a ( RELATED ART )
FIG. 1*a* shows a conventional cushion structure.
Figure 1B:
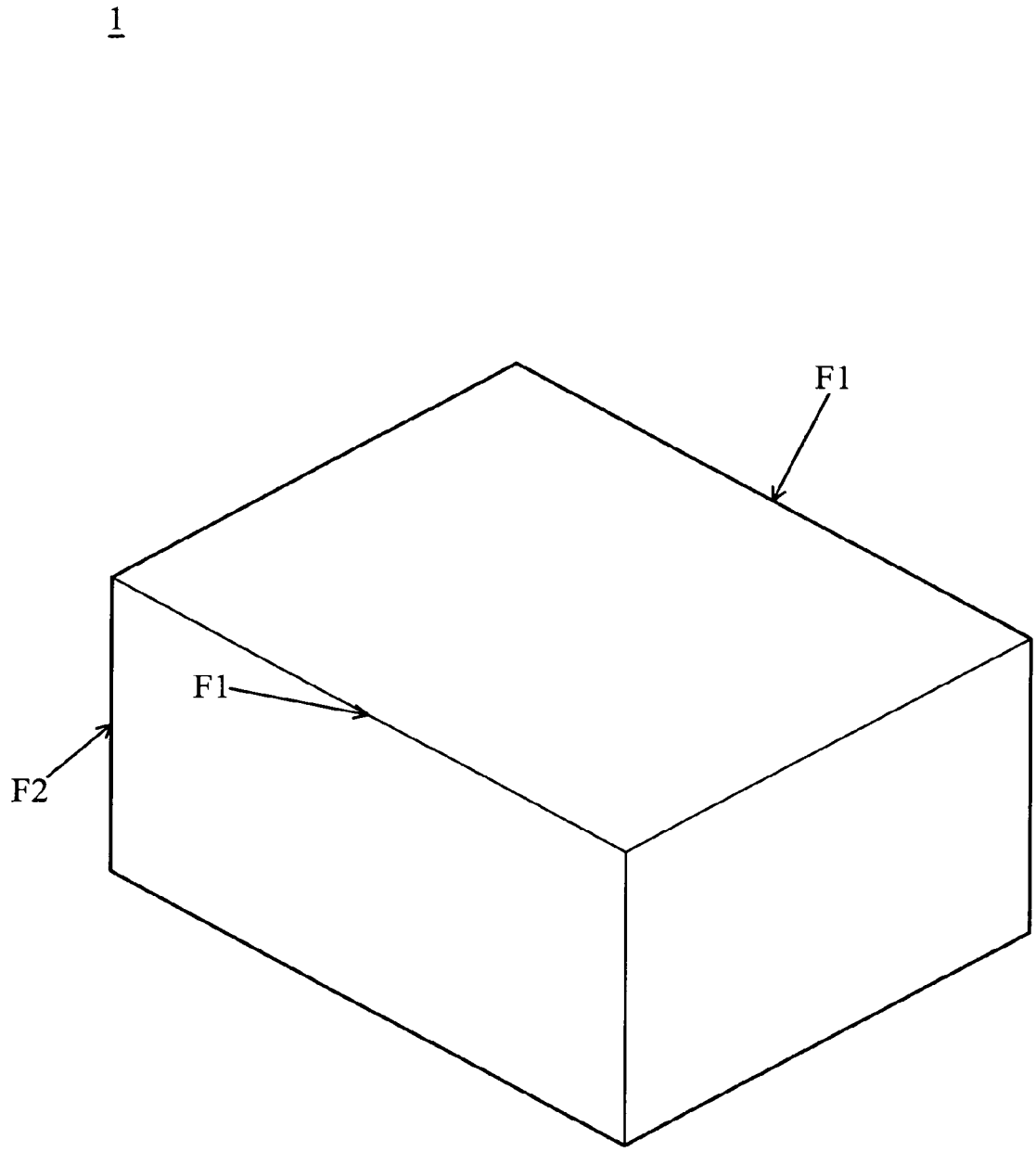
FIG. 1b ( RELATED ART )
FIG. 1*b* shows impact applied on a box having a conventional cushion structure.
Figure 2:
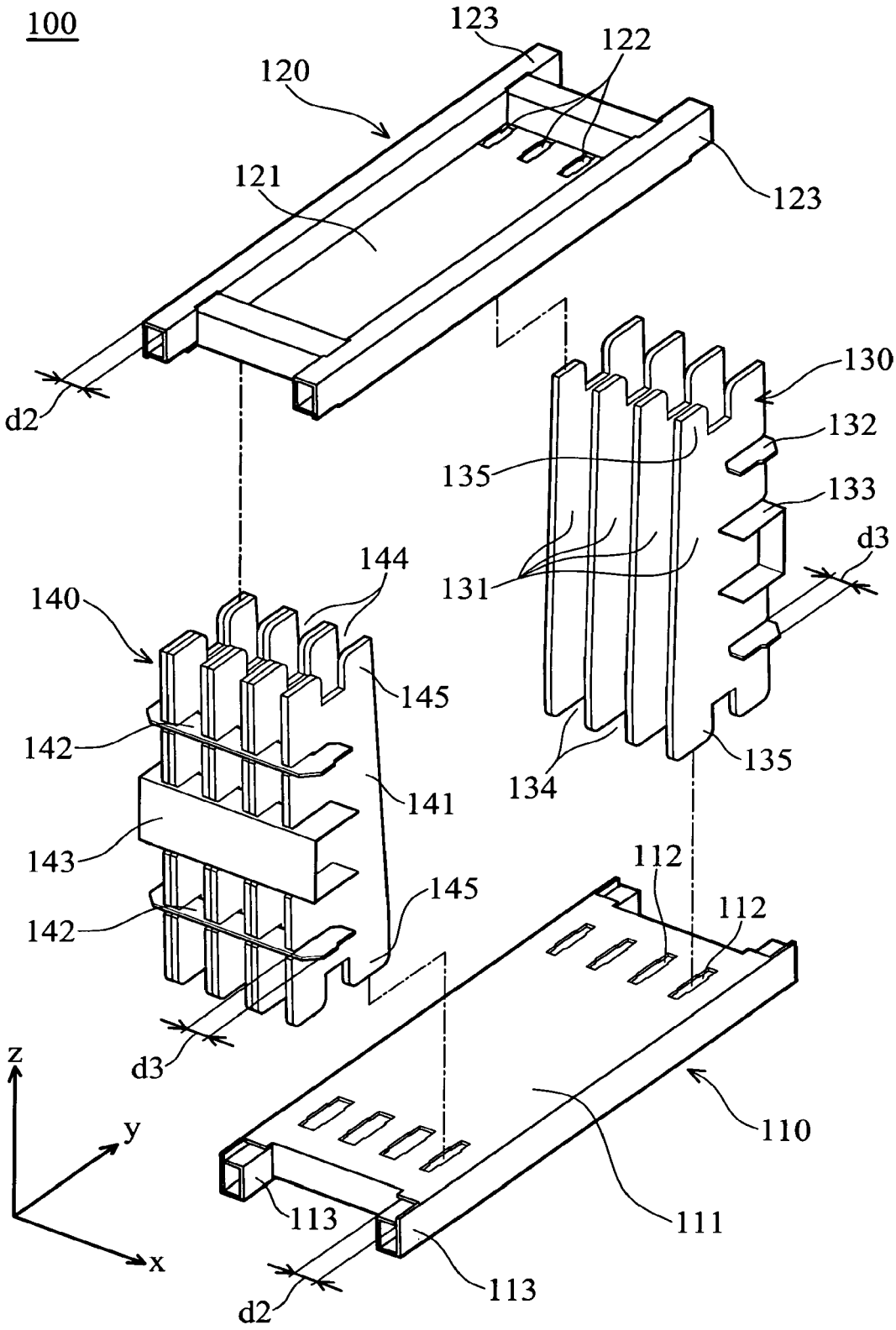
FIG. 2 is an exploded view of a cushion structure of a first embodiment of the invention.

FIG. 2 is an exploded view of a cushion structure 100 of a first embodiment of the invention, which comprises a first fixing element 110, a second fixing element 120, a first cushion element 130 and a second cushion element 140.

The first fixing element 110 comprises a first board 111 and first cushion portions 113. The first board 111 is substantially oblong and comprises an upper surface (first surface) and a plurality of first openings 112. The first openings 112 are aligned in a first direction x and near the two sides of the first board 111. The first cushion portions 113 are longitudinal, extending in a second direction y, disposed on two sides of the first board 111, and comprise width d2 for absorbing impact. The first direction x is perpendicular to the second direction y.

The second fixing element 120 comprises a second board 121 and second cushion portions 123. The second board 121 is substantially oblong and comprises a lower surface (second surface) and a plurality of second openings 122. The second openings 122 are aligned in a first direction x and near two sides of the second board 121. The second cushion portions 123 are longitudinal and extend in a second direction y, disposed on two sides of the second board 121, and comprise width d2 for absorbing impact. The first cushion element 130 comprises first spacers 131 and first ribs 132, 133. Each first spacer 131 comprises first protrusions 135 formed on two ends thereof. The first cushion element 130 is wedged into the first fixing element 110 and the second fixing element 120 by insertion in the first protrusions 135 into the first openings 112 and the second openings 122. The first spacers 131 are parallel to each other and extend in a third direction z. The first spacers 131 are aligned equidistantly and form a plurality of first grooves 134 extending in the third direction z. The third direction z is perpendicular to the first direction x and the second direction y. The first ribs 132, 133 extend in the first direction x and are wedged into the first spacers 131. The first ribs 132 are planar and the first rib 133 comprises a U-shaped cross-section. The ends of the first ribs. 132 and 133 are protruded across the outmost first spacers 131 by a distance d3. The distance d3 is equal to the width d2 of the first cushion portion 113 and the second cushion portion 123. The first ribs 132 and 133 partially absorb impact applied on a side surface of the cushion structure 100.

The second cushion element 140 comprises second spacers 141 and second ribs 142, 143. Each second spacer 141 comprises second protrusions 145 formed on two ends thereof. The second cushion element 140 is wedged into the first fixing element 110 and the second fixing element 120 by insertion in the second protrusions 145 into the first openings 112 and the second openings 122. The second spacers 141 are parallel to each other and extend in a third direction z. The second spacers 141 are aligned equidistantly and form a plurality of second grooves 144 extending in the third direction z. The second ribs 142, 143 extend in the first direction x and are wedged into the second spacers 141. The second ribs 142 are planar and the second rib 143 comprises a U-shaped cross-section. The ends of the first ribs 132 and 133 are protruded across the outmost first spacers 131 by a distance d3. The distance d3 is equal to the width d2 of the first cushion portion 113 and the second cushion portion 123. The second ribs 142 and 143 partially absorb impact applied on a side surface of the cushion structure 100.

The first openings 112 and the second openings 122 are blind holes or through holes. The cushion structure 100 is made of corrugated paper.

Figure 3:
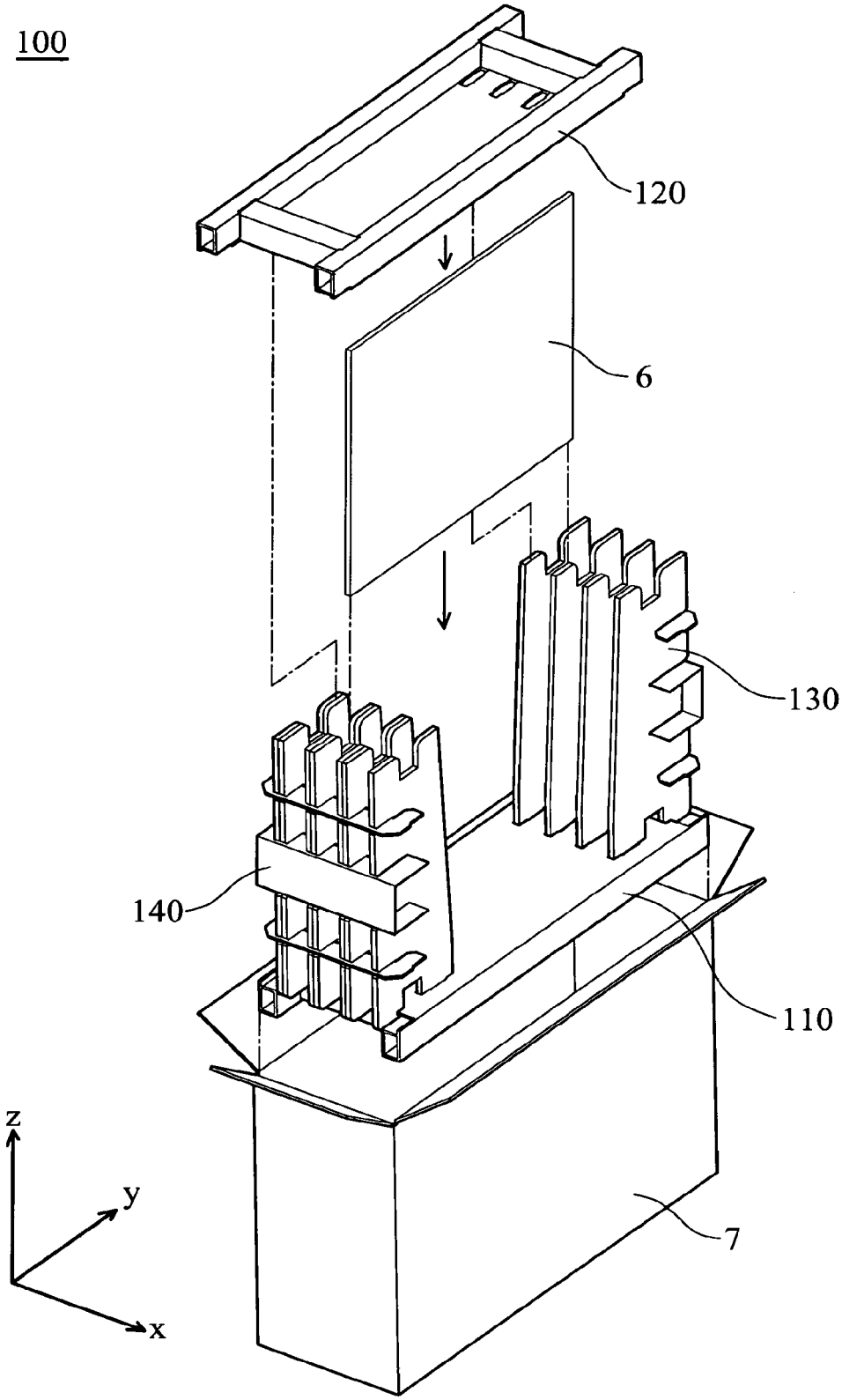
FIG. 3 shows a panel packaged in the cushion structure of the first embodiment of the invention.

As shown in FIG. 3, when a panel 6 is packaged, the first cushion element 130 and the second cushion element 140 are fixed (tightly fitted) on the first fixing element 110. The first cushion element 130, the second cushion element 140 and the first fixing element 110 are then placed in a box 7. Next, the panel 6 is inserted in an insertion direction −z between the first cushion element 130 and the second cushion element 140. The insertion direction is perpendicular to the first surface of the first board 110. Finally, the second fixing element 120 tightly fits the first cushion element 130 and the second cushion element 140.

Figure 4:
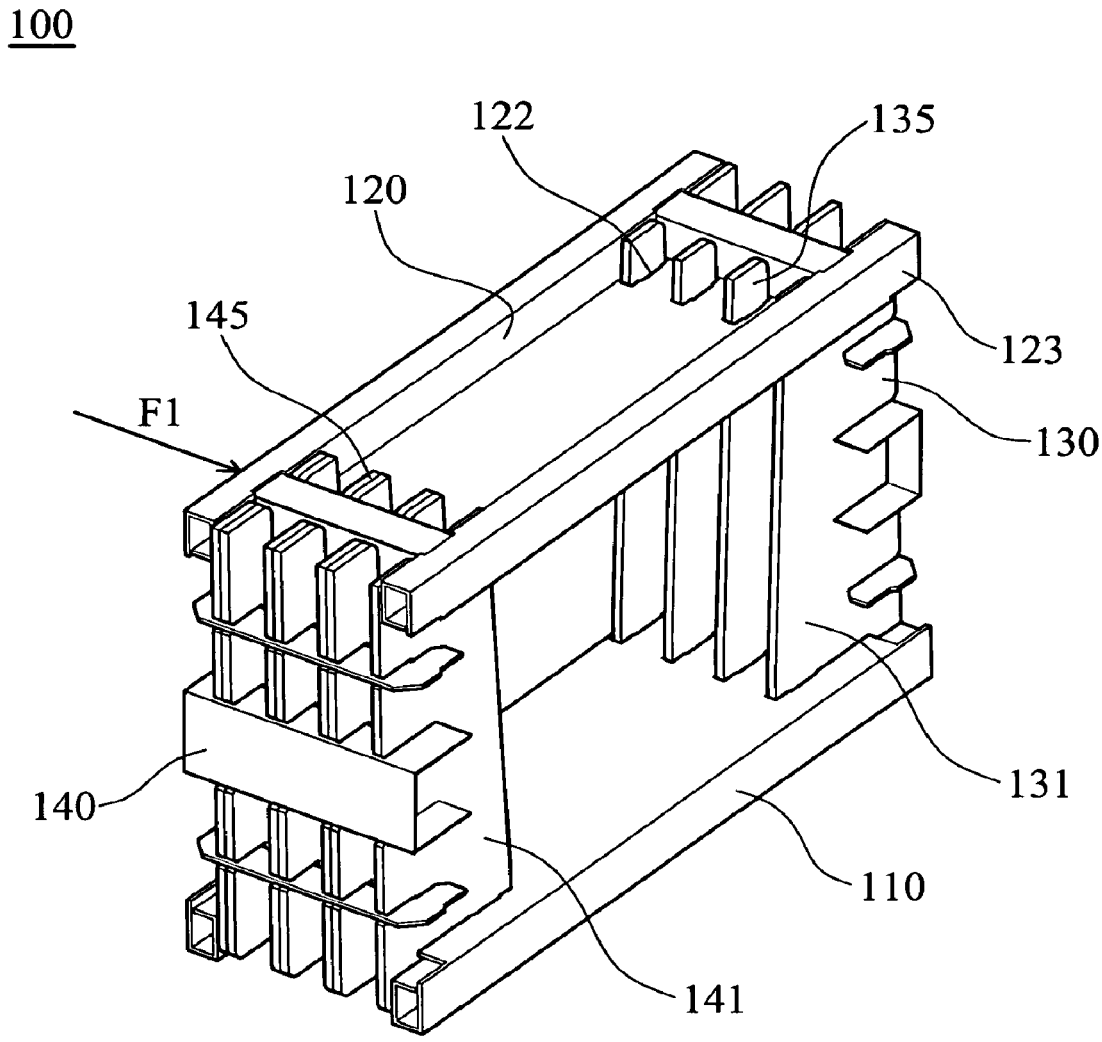
FIG. 4 is a perspective view of the cushion structure of the first embodiment of the invention.

FIG. 4 is a perspective view of the cushion structure 100. In FIG. 4, the box 7 and the panel 6 are omitted to simplify the description. The first cushion element 130 and the second cushion element 140 are wedged into the first fixing element 110 and the second fixing element 120. Thus, the cushion structure 100 of the invention provides improved strength and impact absorption. For example, when the force F1 is applied on an upper edge of the cushion structure 100, the force F1 is received by the whole cushion structure 100 (comprising the fixing element 110, the second fixing element 120, the first cushion element 130 and the second cushion element 140) and finally absorbed by the second cushion portion 123, part of the second board 121 between the second openings 122, the first spacers 131 and the second spacers 141. The cushion structure 100 of the invention provides improved absorption for force F1. Additionally, the first cushion portion, the second cushion portion, the first ribs and the second ribs collectively absorb outer forces. Thus, the size (for example, width d2 or distance d3) and volume of the cushion structure can be reduced.

The cushion structure of the invention absorbs impact applied on every side and edge thereof and protects panel or other breakables packaged therein. Additionally, the size and volume of the cushion structure of the invention are reduced.

Second Embodiment

Figure 5:
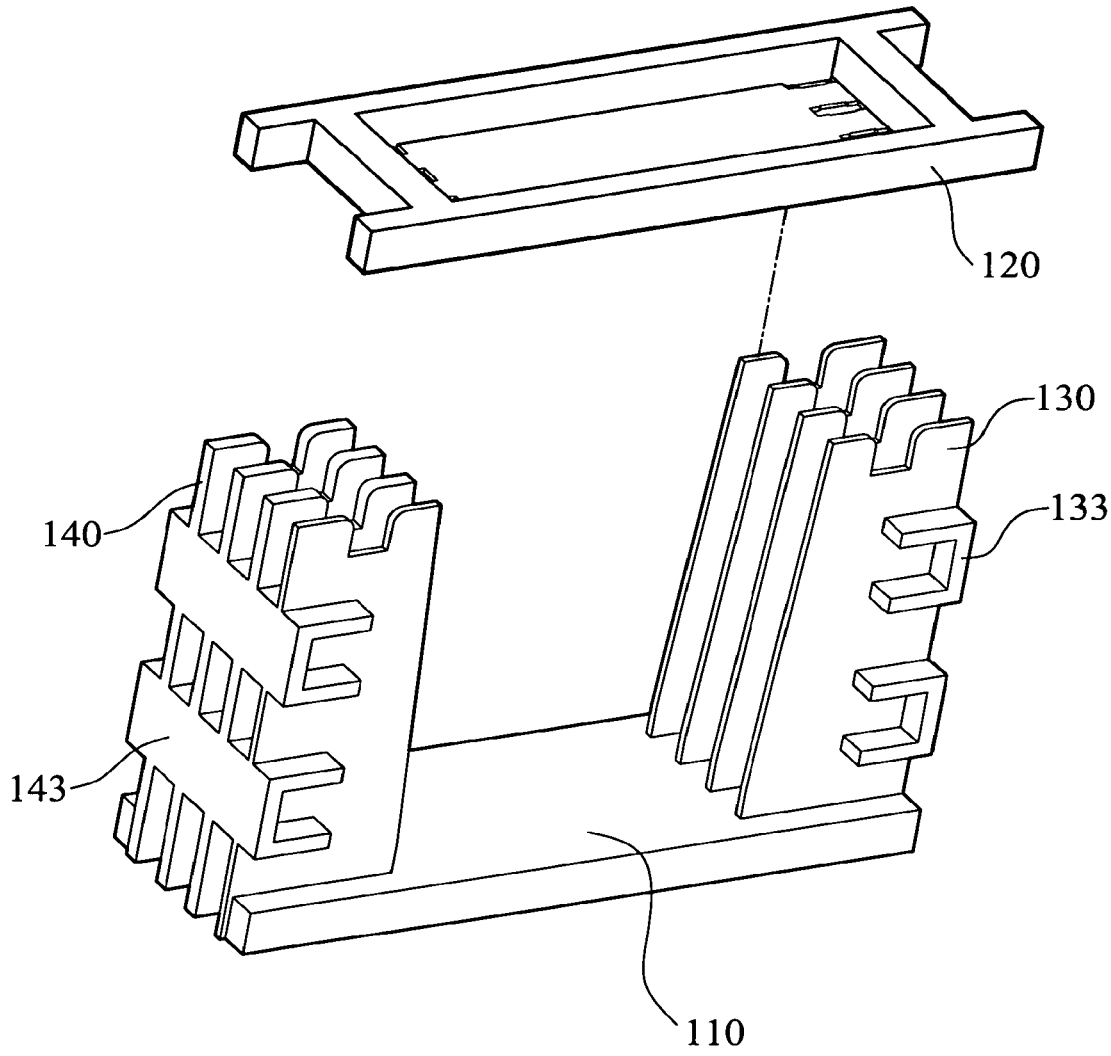
FIG. 5 shows a cushion structure of a second embodiment of the invention.

FIG. 5 shows a second embodiment of the invention, wherein the first cushion element 130 and the second cushion element 140 is integrally formed with the first fixing element 110 to form a U-shaped structure. In the second embodiment, the U-shaped structure is made by injection molding. The first rib 133 and the second rib 143 comprise U-shaped cross-section.

The cushion structure in the second embodiment of the invention is made of foam material.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation to encompass all such modifications and similar arrangements.

The invention claimed is:

1. A cushion structure comprising:

a U-shaped structure, comprising:

a first cushion element comprising a plurality of first ribs and a plurality of first grooves paralleled to each other, wherein the first cushion element has at least one first protrusion formed at one end thereof;

a second cushion element comprising a plurality of second ribs and a plurality of second grooves paralleled to each other, wherein the second cushion element has at least one second protrusion formed at one end thereof;

a second fixing element connecting the first cushion element and the second cushion element to form the U-shaped structure; and a first fixing element comprising a first board having a plurality of first openings;

wherein each of the first protrusions and each of the second protrusions is engaged with each of the first openings.

2. The cushion structure as claimed in claim 1, wherein the first openings are through holes.

3. The cushion structure as claimed in claim 1, wherein the first openings are blind holes.

4. The cushion structure as claimed in claim 1, wherein the cushion structure comprises corrugated paper.

5. The cushion structure as claimed in claim 1, wherein the cushion structure comprises foam material.

6. The cushion structure as claimed in claim 1, wherein the first fixing element comprises at least one first cushion portion.

7. The cushion structure as claimed in claim 1, wherein the second fixing element comprises at least one second cushion portion.

8. The cushion structure as claimed in claim 1, wherein one of the plurality of first ribs comprises a U-shaped cross-section.

9. The cushion structure as claimed in claim 1, wherein one of the plurality of second ribs comprises a U-shaped cross-section.

* * * * *